US007004074B2

(12) United States Patent
Van Stratum

(10) Patent No.: US 7,004,074 B2
(45) Date of Patent: Feb. 28, 2006

(54) CONTROLLED FLUID ENERGY DELIVERY BURST CARTRIDGE

(75) Inventor: Bruce G. Van Stratum, Tallahassee, FL (US)

(73) Assignee: Martin Electronics, Perry, FL (US)

( * ) Notice: Subject to any disclaimer, the term of this patent is extended or adjusted under 35 U.S.C. 154(b) by 117 days.

(21) Appl. No.: 10/187,038

(22) Filed: Jul. 1, 2002

(65) Prior Publication Data

US 2004/0000250 A1 Jan. 1, 2004

(51) Int. Cl.
*F42B 5/00* (2006.01)

(52) U.S. Cl. ..... 102/470; 102/430; 102/469

(58) Field of Classification Search ..... 102/430, 102/440, 441, 442, 444, 446, 447, 448, 454, 102/456, 457, 469, 470
See application file for complete search history.

(56) References Cited

U.S. PATENT DOCUMENTS

| | | | | | |
|---|---|---|---|---|---|
| 89,563 | A | * | 5/1869 | Daw | 102/469 |
| 99,899 | A | * | 2/1870 | Hotchkiss | 102/470 |
| 116,094 | A | * | 6/1871 | Powers | 102/470 |
| 148,366 | A | * | 3/1874 | Hobbs | 102/470 |
| 278,394 | A | * | 5/1883 | Bullard | 102/470 |
| 3,728,967 | A | * | 4/1973 | Hinkle et al. | 102/472 |
| 3,771,451 | A | * | 11/1973 | Woodring | 102/430 |
| 3,935,816 | A | | 2/1976 | Boquette | |
| 3,983,817 | A | * | 10/1976 | Tucker | 102/513 |
| 4,164,903 | A | | 8/1979 | Bouza | |
| 4,370,930 | A | * | 2/1983 | Strasser et al. | 102/530 |
| 4,493,263 | A | | 1/1985 | Carabateas | |
| 4,587,905 | A | * | 5/1986 | Maki | 102/430 |
| 4,887,674 | A | | 12/1989 | Galosky et al. | |
| 4,892,038 | A | * | 1/1990 | Lubbers | 102/439 |
| 4,913,054 | A | * | 4/1990 | Petersen | 102/439 |
| 5,078,117 | A | | 1/1992 | Cover | |
| 5,086,703 | A | | 2/1992 | Klein | |
| 5,259,319 | A | | 11/1993 | Dravecky et al. | |
| 5,341,744 | A | * | 8/1994 | Shi | 102/442 |
| 5,353,779 | A | | 10/1994 | Lyon | |
| 5,402,729 | A | | 4/1995 | Richert | |
| 5,408,931 | A | * | 4/1995 | Tallman | 102/439 |
| 5,429,054 | A | | 7/1995 | Topping | |
| 5,493,975 | A | * | 2/1996 | Franzini et al. | 102/531 |
| 5,703,322 | A | | 12/1997 | Tidman | |

(Continued)

FOREIGN PATENT DOCUMENTS

| | | |
|---|---|---|
| CH | 302184 | * 12/1954 |

(Continued)

*Primary Examiner*—Peter M. Poon
*Assistant Examiner*—David J. Parsley
(74) *Attorney, Agent, or Firm*—J. Wiley Horton

(57) ABSTRACT

A modified gas delivery cartridge. A conventional straight-sided brass cartridge case is primed and then filled with solid propellant. A burst cup is then inserted in the case mouth. The burst cup is embossed with a cross or other shape to promote predictable rupture. Once the burst cup is in place, the upper edges of the cartridge case are rolled over the burst cup. In operation, the propellant is ignited to produce pressure within the sealed case. This pressure builds steadily until the embossed cross in the burst cup ruptures. The propellant gases are then vented in a metered fashion through the ruptured burst cup. However, the burst cup is retained by the case so that no solid object escapes the high pressure cartridge. In addition, by carefully designing the shape of the burst cup and the components surrounding it, it is possible to create an efficient expansion nozzle to better meter the propellant gases.

8 Claims, 20 Drawing Sheets

U.S. PATENT DOCUMENTS

| | | | | | |
|---|---|---|---|---|---|
| 5,834,681 | A | * | 11/1998 | DuBay | 102/430 |
| 5,936,189 | A | * | 8/1999 | Lubbers | 102/439 |
| 6,041,712 | A | | 3/2000 | Lyon | |
| 6,189,926 | B1 | | 2/2001 | Smith | |
| 6,198,718 | B1 | | 3/2001 | Watanabe et al. | |
| 6,230,733 | B1 | | 5/2001 | Strelow et al. | |
| 6,328,906 | B1 | | 12/2001 | Lundstrom et al. | |
| 6,532,402 | B1 | | 3/2003 | Ostwald et al. | |
| 6,619,211 | B1 | * | 9/2003 | Haeselich | 102/513 |

FOREIGN PATENT DOCUMENTS

| | | | |
|---|---|---|---|
| GB | 3065 | * | 1/1872 |
| GB | 253395 | * | 6/1926 |
| WO | WO 93/23717 | * | 11/1993 |

* cited by examiner

CONTROLLED FLUID ENERGY DELIVERY BURST CARTRIDGE

This invention relates to the field of propellant gas delivery systems. More specifically, the invention comprises an energy delivery cartridge with a burst cap that allows controlled discharge of the propellant gases generated within said cartridge.

DESCRIPTION OF THE RELATED ART

Metallic cartridges have been used to encapsulate solid propellants for many years. In recent years other materials have been substituted for the traditional brass, but the principles of operation remain the same: A projectile is seated in the open mouth of a cartridge case containing solid propellant. Ignition of the propellant is provided by percussive or electrical means. The burning propellant generates pressurized gas which forces the projectile out of the mouth of the case and then typically through a barrel bore.

A representative metallic cartridge design is found in the NATO 5.56×45 mm rifle cartridge. In that design, 24 grains of propellant are used to accelerate a 62 grain projectile to a velocity of 3100 feet per second. A more complex system is used where the intention is to accelerate a relatively large mass (relative to the amount of propellant involved) to a relatively low velocity. Such a system is disclosed in U.S. Pat. No. 5,086,703 to Klein (1992). The Klein device is a low-velocity riot control projectile. A metallic cartridge is used to contain a charge of solid propellant in the base of the projectile. The propellant is held within the metallic cartridge by the seating of a disc over the top of the propellant (commonly called a "wad"). Such a cartridge—having no projectile other than the wad—is often called a "blank." When the cartridge is fired, high pressure propellant gases expel the wad and the cartridge then vents the gases into the space beneath the projectile. The gases then force the projectile forward with respect to the metallic cartridge. The result is the creation of a high pressure chamber within the metallic cartridge and a low pressure chamber within the space behind the projectile—as the projectile moves forward to exit the weapon. Such a system is often referred to as a "Hi/Low" gas delivery system.

U.S. Pat. No. 5,259,319 to Dravecky et.al. (1993) discloses another type of Hi/Low system. The Dravecky invention is a reusable practice round for 37 mm and 40 mm grenade launching weapons. It used a .38 caliber "blank" cartridge as the high pressure component (see FIG. 2). The blunt-nosed object projecting from the end of the .38 caliber metallic cartridge is the sealing wad. As those skilled in the art will know, the use of such a wad has traditionally been essential to the function of a blank cartridge. Normal cartridge cases have bullets seated in their mouths (either via an interference fit, crimping, or both). When the propellant is ignited, pressure within the case builds to many atmospheres before the bullet begins to move. This elevated pressure is an essential component of reliable ignition. If, as an example, a case having no obstruction at the mouth is ignited, it will burn erratically or often not at all (sometimes called a "chuff"). Thus, the use of a pressure containment wad is essential.

Traditional wads are capable of providing reliable ignition, but less than ideal for a Hi/Low system. Once the wad clears the mouth of the case, the pressure drop within the case is substantial. This fact causes most of the propellant gases to be expelled in a short period, and may also promote incomplete burning of the propellant. A system for metering the expulsion of the gases is therefore desirable. U.S. Pat. No. 5,402,729 to Richert discloses such a system. With respect to FIG. 1 of the Richert specification, the reader will note that a blank cartridge (2) is placed within a diffusing device (3). Although not clearly described, the blank cartridge (2) appears to be of the molded-propellant type, wherein a solid propellant with an added plasticizer is molded into the shape of a cartridge without the use of a case. This is possible since diffusing device (3) essentially serves the purpose of a traditional case. Diffusing device (3) has a series of radial metering holes (**3*b***) which meter the propellant gases into the low pressure chamber.

The Richert device thus solves the metering problem and has the added advantage of not expelling a wad (since it has no wad). The expulsion of a wad is a decided drawback to the other devices. The wad tends to follow an erratic flight path and can strike unintended targets. In addition, many wads will accumulate in the area of a practice range introducing a pollution problem. However, the Richert device has the disadvantage of using unconventional components. The blank cartridge and the diffusing device must be specially manufactured, adding to the cost. The use of more conventional munitions components is preferable.

U.S. Pat. No. 6,041,712 to Lyon (2000) discloses a Hi/Low system using a standard .38 caliber cartridge. However, the .38 caliber cartridge is contained within a metal sleeve with a metering hole (see FIG. 3). The metering hole is initially covered by a diaphragm (18). This combination serves to replace the wad and provides sufficient pressure containment for reliable ignition. FIG. 4 illustrates an embodiment using a standard .38 caliber blank cartridge, including a wad—plug (19). The embodiment shown in FIG. 3 has the benefit of improved gas metering, but it also requires the use of the additional metal sleeve. This is a non-standard component which increases the cost of the device. The embodiment showing in FIG. 4 suffers from the drawbacks previously discussed—poor gas metering and the ejection of a wad.

Finally, the reader should be aware that Hi/Low gas cartridge systems are used in many fields other than munitions. As one example, consider U.S. Pat. No. 6,189,926 to Smith (2001). The Smith device uses a complex high pressure cartridge to vent propellant gases into a low pressure chamber. The low pressure chamber is then used to inflate an automotive air bag. The propellant containing case is designed to rupture—thereby venting the gas. A close inspection of the drawings reveals that the device is quite complex, and consequently quite expensive. It is therefore unsuitable for use in a projectile practice round. However, it does serve to illustrate the fact that cartridge gas venting systems have many different applications. These would additionally include, without limitation:

1. Turbine and piston engine starters;
2. Parachute inflation devices;
3. Mechanical deployment device;
4. Life vest inflation devices;
5. Life boat inflation devices; and
6. Explosive bolt cutting device.

BRIEF SUMMARY OF THE INVENTION

The present invention is a modified fluid delivery cartridge. FIGS. 5 through 8 illustrate the primary features. A conventional straight-sided brass cartridge case is primed and then filled with solid propellant. A burst cap is then inserted in the case mouth. The burst cap is scribed with a cross, as shown in FIG. 6. Once the burst cap is in place, the upper edges of the cartridge case are rolled over the burst cap, as shown in FIG. 8.

In operation, the propellant is ignited to produce pressure within the sealed case. This pressure builds steadily until the scribed cross in the burst cap ruptures. The propellant gases are then vented in a metered fashion through the ruptured burst cap. However, the burst cap is retained by the case so that no solid object escapes the high pressure cartridge. In addition, by carefully designing the shape of the burst cap and the components of the low pressure chamber, it is possible to create an efficient expansion nozzle to better meter the propellant gases.

REFERENCE NUMERALS IN THE DRAWINGS

Figure 1:
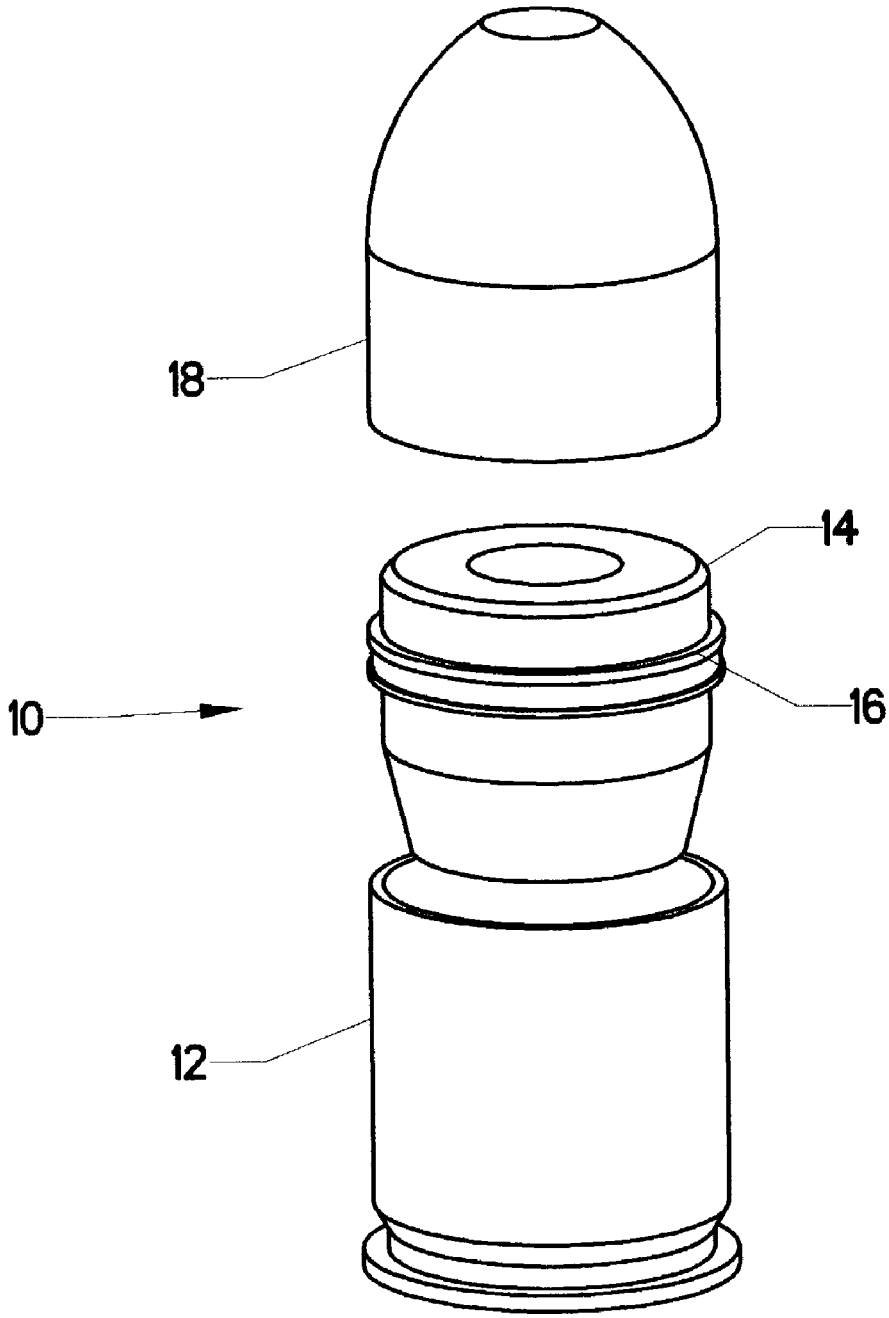
FIG. 1 (PRIOR ART)
FIG. 1 is an isometric view, showing a prior art practice round.

| | | | |
|---|---|---|---|
| 10 | practice round | 12 | low pressure case |
| 14 | projectile body | 16 | rifling ring |
| 18 | nose cone | 20 | dye charge |
| 22 | extraction flange | 24 | base |
| 26 | side wall | 28 | charge casing |

-continued

REFERENCE NUMERALS IN THE DRAWINGS

| | | | |
|---|---|---|---|
| 30 | low pressure chamber | 32 | blank cartridge |
| 34 | percussion primer | 36 | propellant |
| 38 | filler plug | 40 | wad |
| 42 | high pressure cartridge | 44 | roll crimp |
| 46 | burst cup | 48 | embossed lines |
| 50 | modified crimp | 52 | charge vent hole |
| 54 | burst petal | 56 | expansion nozzle |
| 58 | uncrimped case | 60 | bulkhead |
| 62 | modified blank cartridge | 64 | air bag cartridge |
| 66 | low pressure case | 68 | diffuser |
| 70 | vent holes | 72 | mounting flange |
| 74 | electrical primer | 76 | necked cartridge |
| 78 | neck | 80 | low wall case |
| 82 | M583 case | 84 | projectile container |
| 86 | cap | 88 | container base |
| 90 | delay charge | 92 | output charge |

DESCRIPTION OF THE INVENTION

Figure 2:
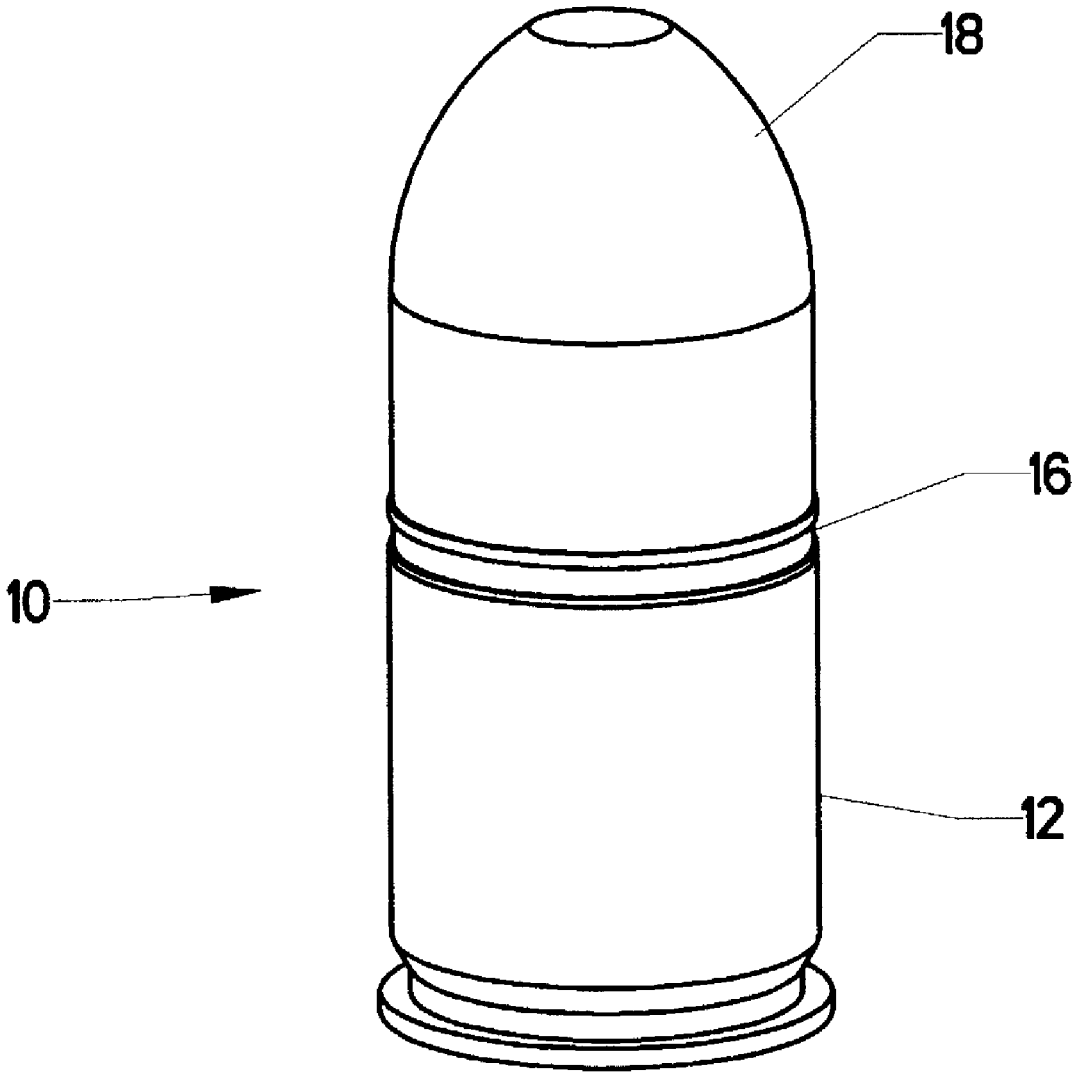
FIG. 2 (PRIOR ART)
FIG. 2 is an isometric view, showing a prior art practice round.
Figure 3:
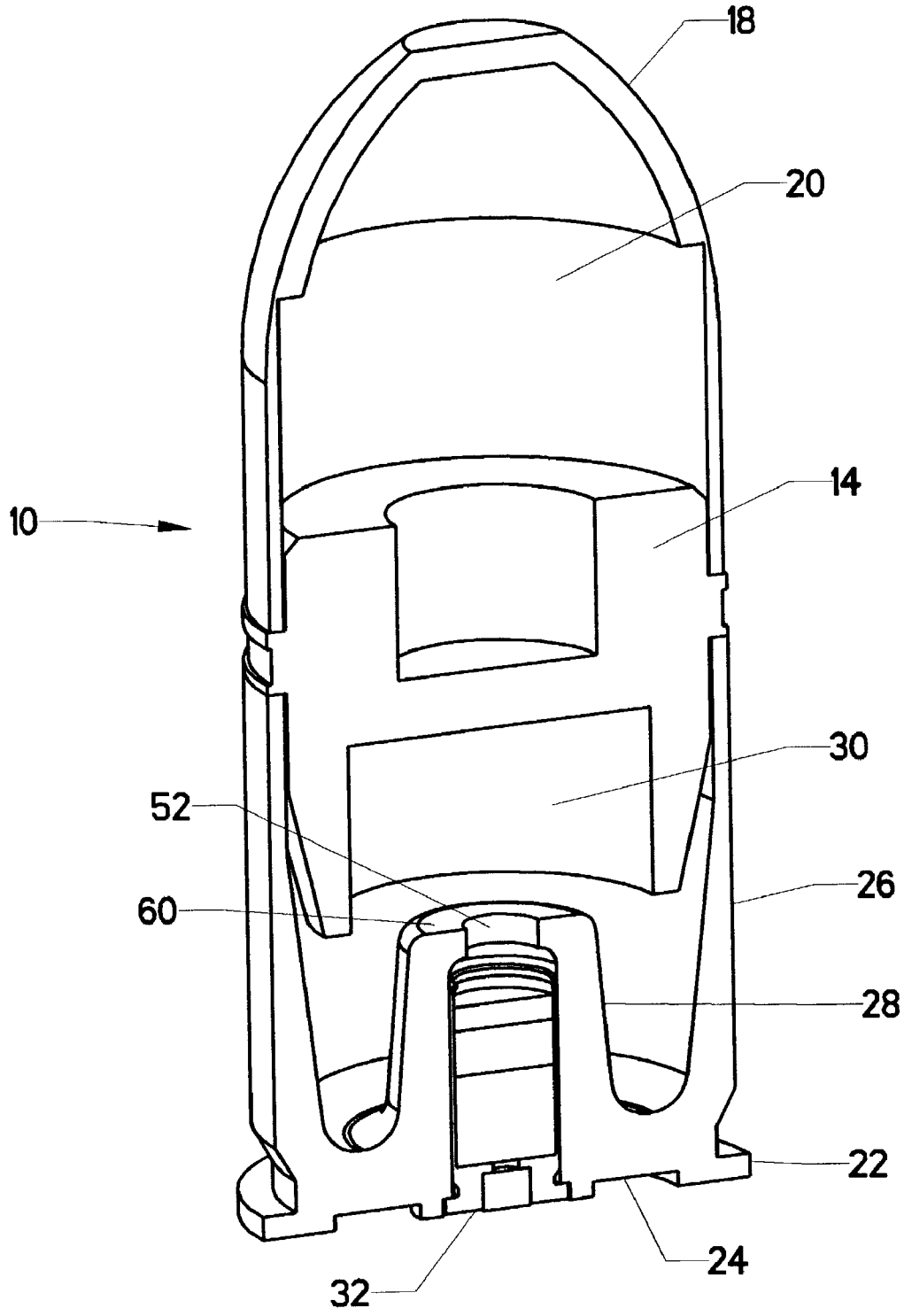
FIG. 3 (PRIOR ART)
FIG. 3 is a section view, showing the internal features of a prior art practice round.

FIG. 1 shows a prior art practice round 10 (containing marking dye) for a grenade launching weapon. It has three major inert components: case 12, projectile body 14, and nose cone 18. FIG. 2 shows the components assembled as they normally would be prior to firing. FIG. 3 is a section view, showing some internal features of the prior art practice round 10. Low pressure case 12 is formed of base 24 with an attached cylindrical side wall 26. Extraction flange 22 extends out from base 24. It provides an engagement point for an extracting mechanism to pull the round free of the weapon.

Charge casing 28 extends upward from base 24. Bulkhead 60 closes the upper portion of charge casing 28. It is pierced by charge vent hole 52. Low pressure case 12 is typically formed as one integral piece—either as a metallic casting or as molded plastic.

Charge casing 28 and bulkhead 60 combine to form a structure to support blank cartridge 32. Blank cartridge 32 supplies high pressure propellant gases which are fed through charge vent hole 52 into low pressure chamber 30. Low pressure chamber 30 is formed by seating projectile body 14 into low pressure case 12. Projectile body 14 has a cavity in its base which tends to receive the hot pressurized propellant gases escaping from charge vent hole 52. Projectile body 14 is typically formed from a metal capable of withstanding the hot propellant gases. Nose cone 18 is bonded onto the top of projectile body 14. It contains dye charge 20, which ejects a dye marking at the point of impact, thereby allowing the operator to observe the fall of the shot.

In operation, practice round 10 is placed within a grenade launcher, which typically consists of a firing chamber connected to a short, rifled barrel. Once secured within the launcher, blank cartridge 32 is detonated. The ejection of propellant gases forces projectile body 14, along with nose cone 18 and the contained dye charge 20 through the rifled bore. Returning briefly to FIG. 1, the reader will observe that rifling ring 16 extends outward from projectile body 14. Its purpose is to engage the rifling within the barrel, thereby spin-stabilizing the projectile in flight.

Figure 4:
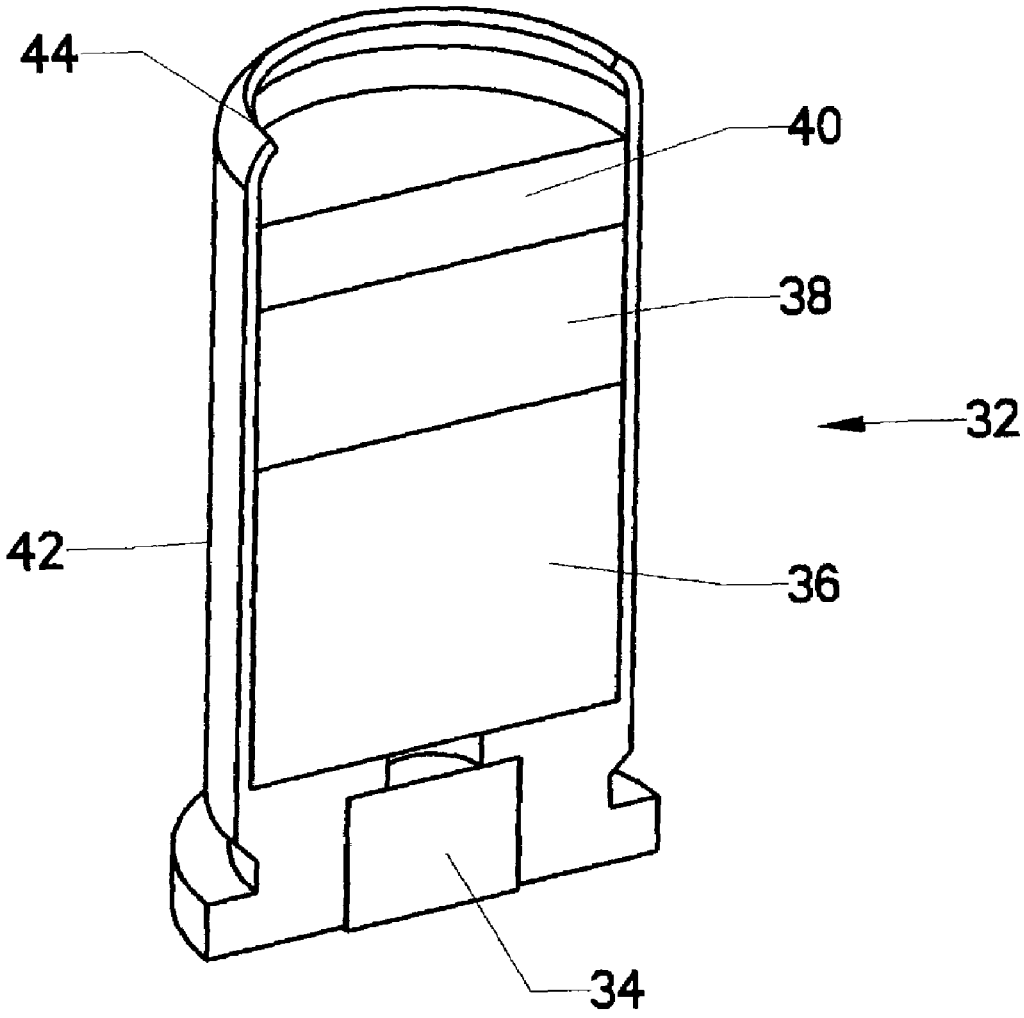
FIG. 4 (PRIOR ART)
FIG. 4 is an isometric view, showing the internal features of a blank cartridge.

FIG. 4 is a section view illustrating the internal features of the prior art blank cartridge 32. High pressure cartridge 42 has a base and a base cylindrical vertical side wall. The use of a .38 caliber case is shown. The choice of this case is merely one of expedience, as many types of blank cartridges would work. However, as the .38 caliber case is a very common pistol round, it is cheap and readily available. The case is charged with propellant 36 (such as the solid flake type). This would typically be a nitrocellulose powder, in either spherical or cylindrical form. A percussion primer 34 is seated in the base of blank cartridge 32.

Those skilled in the art will know that the placement of the powder charge within a case has a significant effect on the ignition and burning of the powder. The volume of powder used is set by the ballistic result required; i.e., within a reasonable range, more powder means more velocity to the projectile. It is often true that the powder charge required does not fill the volume of the case. This is particularly true with blank cartridges, since the bullet volume is unoccupied. If the powder is left free in the case, it may settle away from percussion primer 34, especially when the case is oriented horizontally. In such a situation, unreliable ignition may occur.

Looking at FIG. 4, the reader will observe that propellant 36 does not occupy the entire volume of the case. Thus, filler plug 38 is used to hold propellant 36 in place proximate percussion primer 34. Wad 40 is placed over filler plug 38. The upper portion of the case side walls are then deformed to create roll crimp 44. This crimp holds the wad and filler in the desired location.

Wad 40 is typically formed of heavy card stock, while filler plug 38 is often a softer material—such as an open celled foam. When the practice round is fired, wad 40 and filler plug 38 are ejected into the rifled bore. Most of the mass is ejected downrange. However, it is important to realize that wad 40 and filler plug 38 will be broken into smaller particles that intermingle with the very hot propellant gases. Some of these solids then become attached to the firing chamber and barrel wall (commonly called "fouling"). Such fouling tends to build up rapidly, requiring the frequent cleaning of the weapon.

In addition, while wad 40 does serve to keep the components oriented, it cannot withstand significant pressure. It is, in fact, a poor substitute for a bullet. In a conventional cartridge, the bullet's mass retards its forward motion and allows the pressure within the case to build gradually. In a blank cartridge such as shown in FIG. 4, wad 40 has very little mass. As a consequence it is rapidly ejected before the pressure can build evenly. This phenomenon produces an unwanted variation in the burning of the propellant. Such a variation produces variations in the projectile velocity, which limits the device's effectiveness as a training aid since the operator is unable to determine whether a missed shot was caused by poor aim or poor blank cartridge performance.

Figure 5:
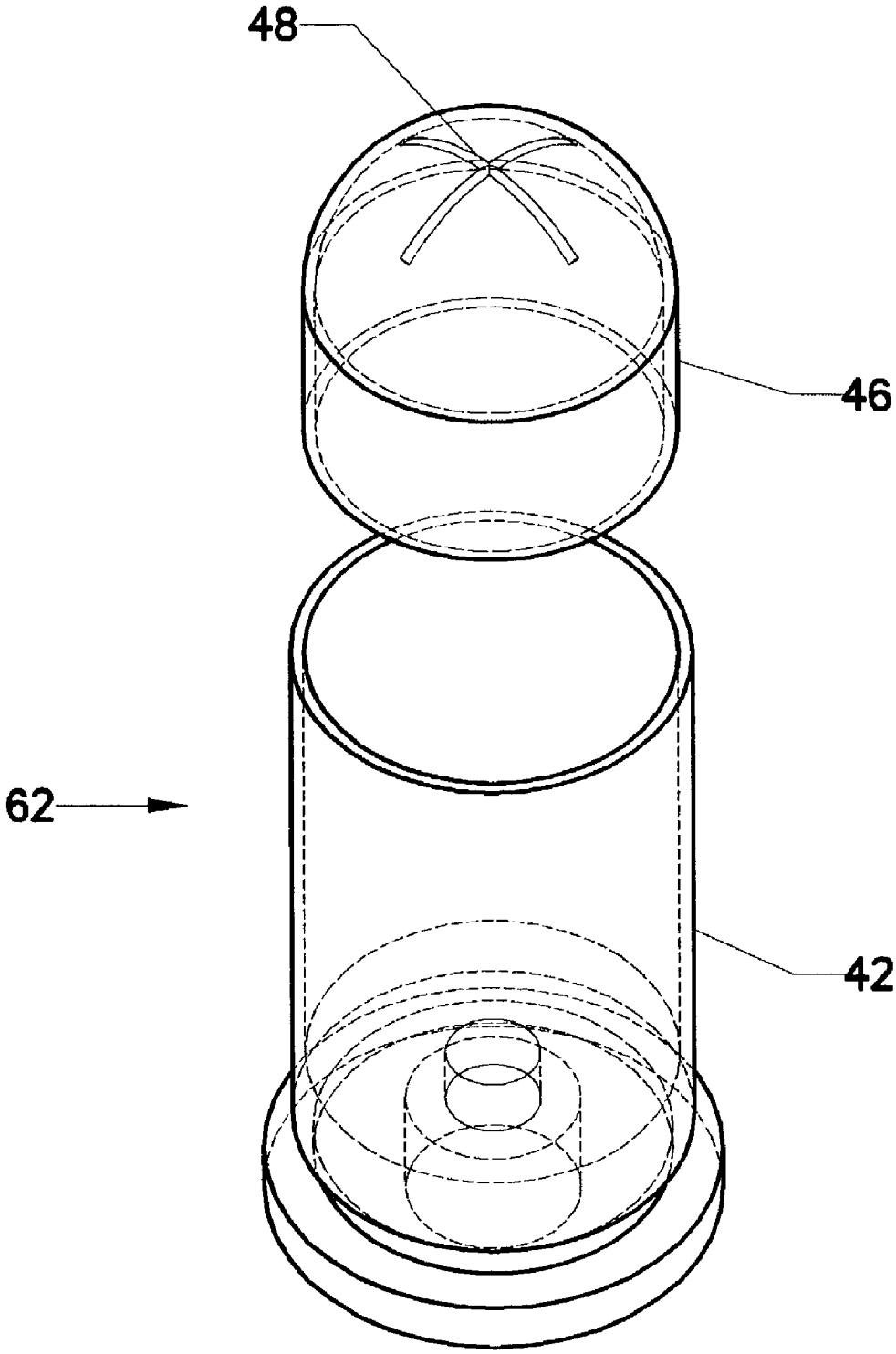
FIG. 5 is an isometric view, showing the burst cap in its relation to the high pressure cartridge.

The present invention produces a much more stable ignition and burn sequence, thereby producing more consistent velocities. In addition, the present invention eliminates the ejection of solid objects which can foul the weapon's bore. FIG. 5 shows the major components of modified blank cartridge 62. High pressure cartridge 42 is the same as for the prior art, including the use of a percussive primer and a propellant charge (also typically solid flake). Burst cup 46 is a hollow, thin-walled object having the approximate external appearance of a bullet.

Figure 6:
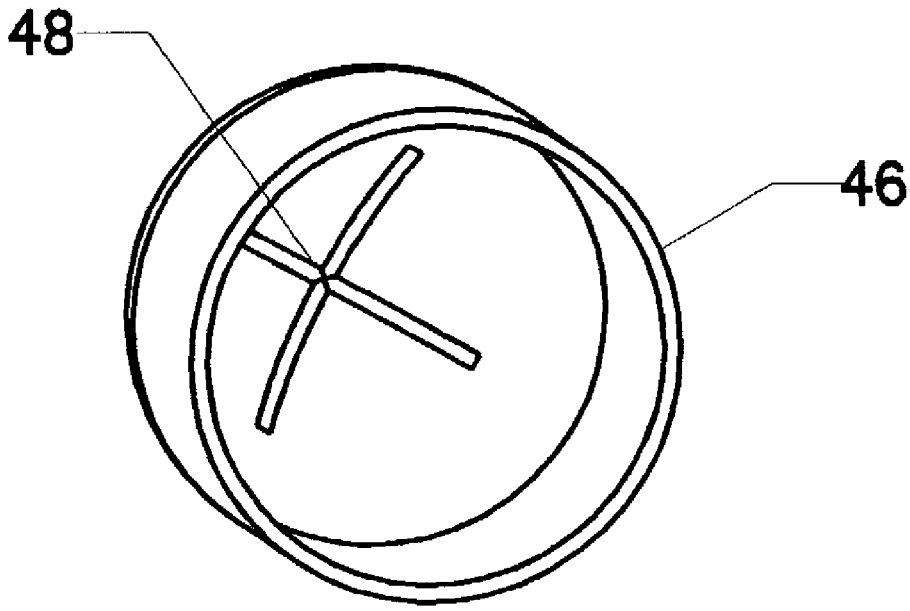
FIG. 6 is an isometric view, showing more features of the burst cap.
Figure 7:
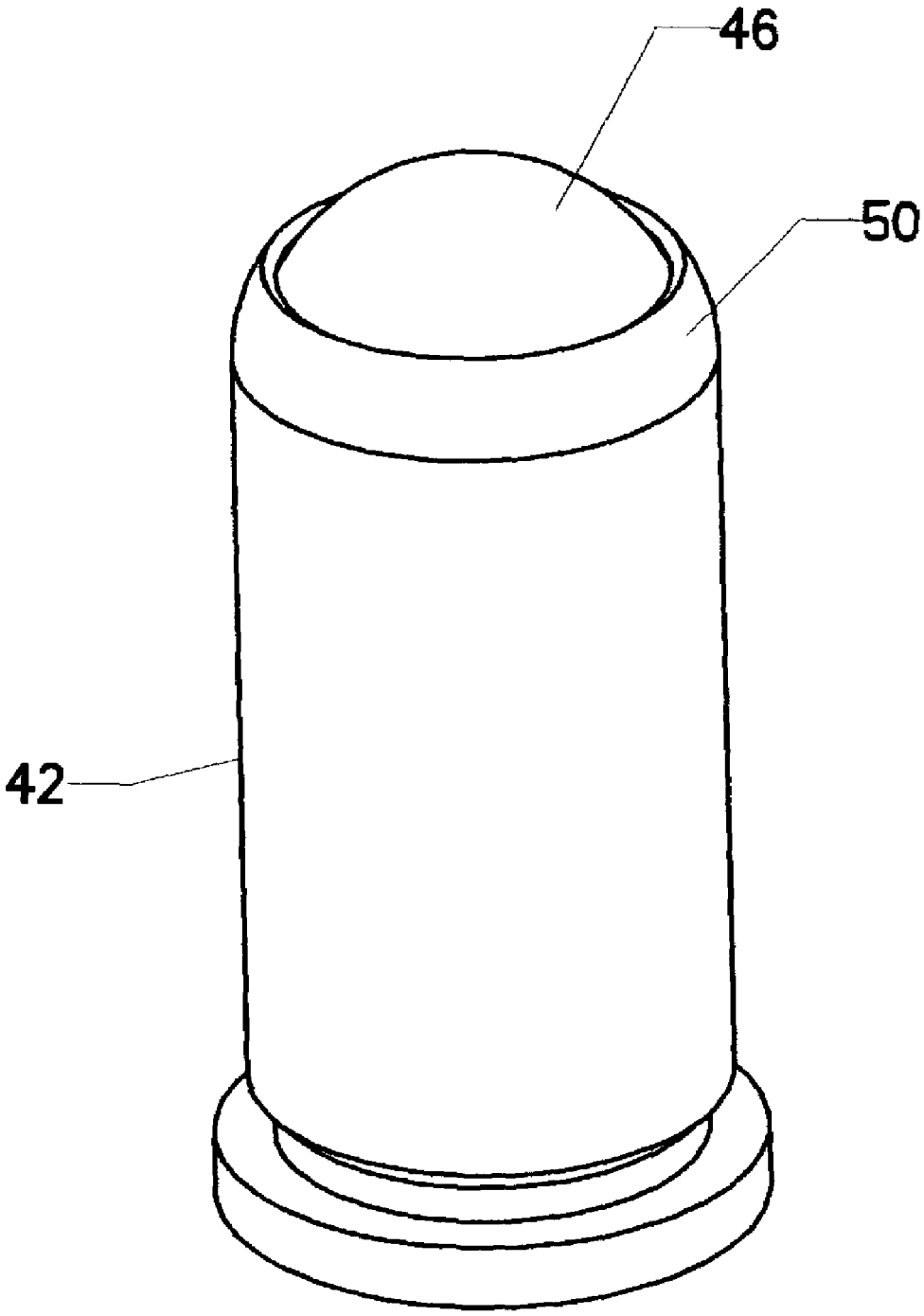
FIG. 7 is an isometric view, showing the burst cap installed within the high pressure cartridge.

FIG. 6 illustrates the hollow nature of burst cup 46. The interior surface of burst cup 46 is embossed with embossed lines 48 (the external surface could be scribed instead, or both surfaces could be scribed). FIG. 7 shows burst cup 46 placed within high pressure cartridge 42. The upper portion of the side wall of the case has been rolled over to form modified crimp 50. This feature retains burst cup 46 within high pressure cartridge 42.

Figure 8:
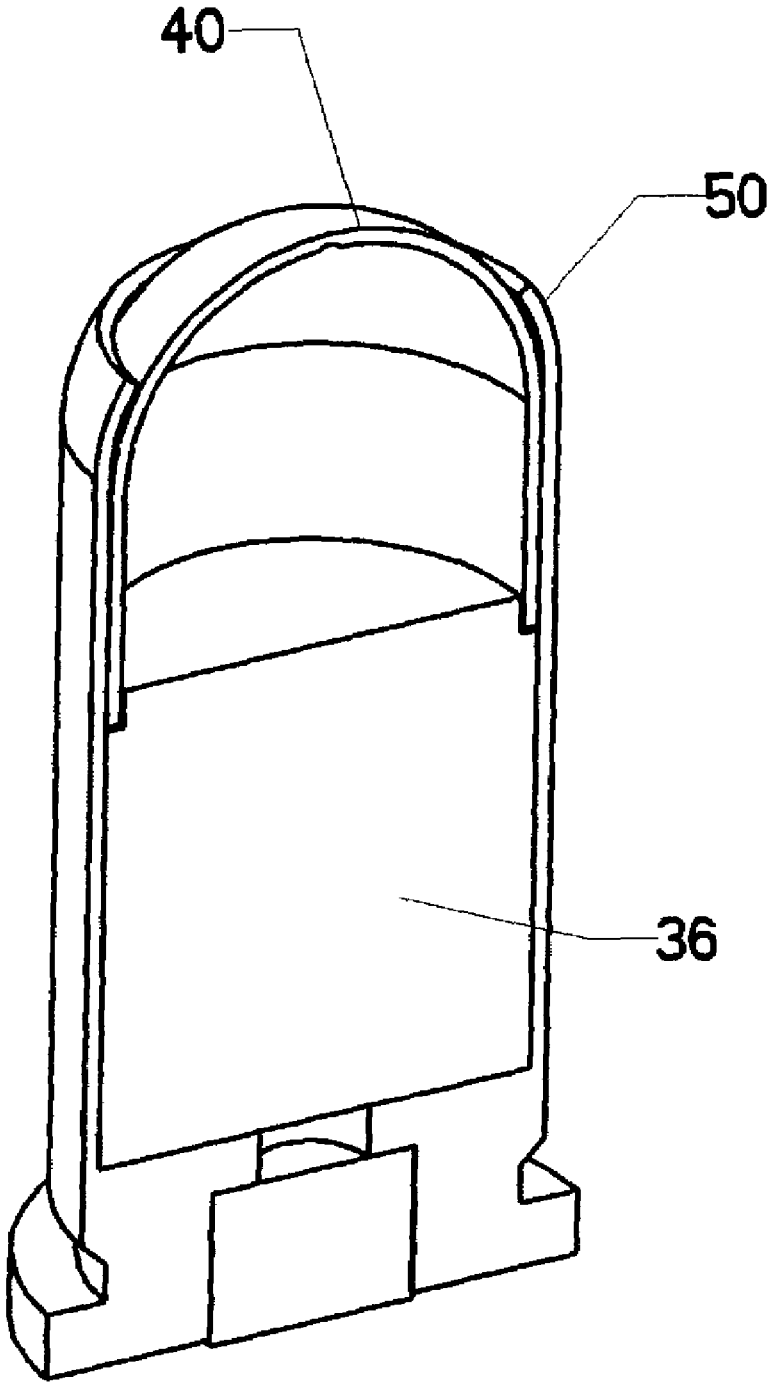
FIG. 8 is a section view, showing the burst cap installed within the high pressure cartridge.

FIG. 8 is a sectional view showing how burst cup 46 is secured by modified crimp 50. Burst cup 46 is essentially a thin cylindrical side wall joined to a hemispherical dome. The cylindrical side wall is sized to slide within but tightly frictional engage the inner cylindrical side wall of high pressure cartridge 42. This frictional engagement prevents burst cup 46 from seating too deep within high pressure cartridge 42. The reader will note in FIG. 8 that some air space is left within high pressure cartridge 42. As explained previously, unoccupied propellant volume can produce erratic ignition in blank cartridges. However, because burst cup 46 forces a dramatic rise in pressure within the case prior to rupturing, no erratic ignition occurs. In a conventional cartridge with a seated bullet, air space often remains. This does not tend to produce a problem in that circumstance because—again—the bullet's mass allows the build-up of high pressure.

Figure 9:
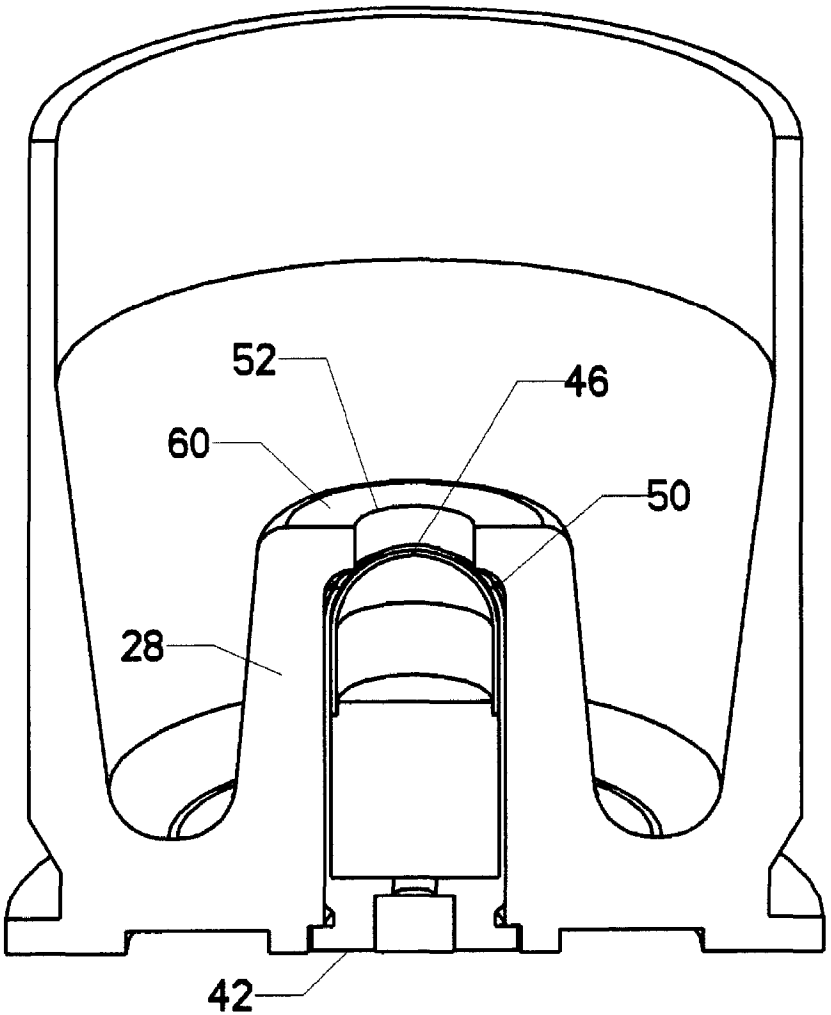
FIG. 9 is a section view, showing the components of the present invention.
Figure 10:
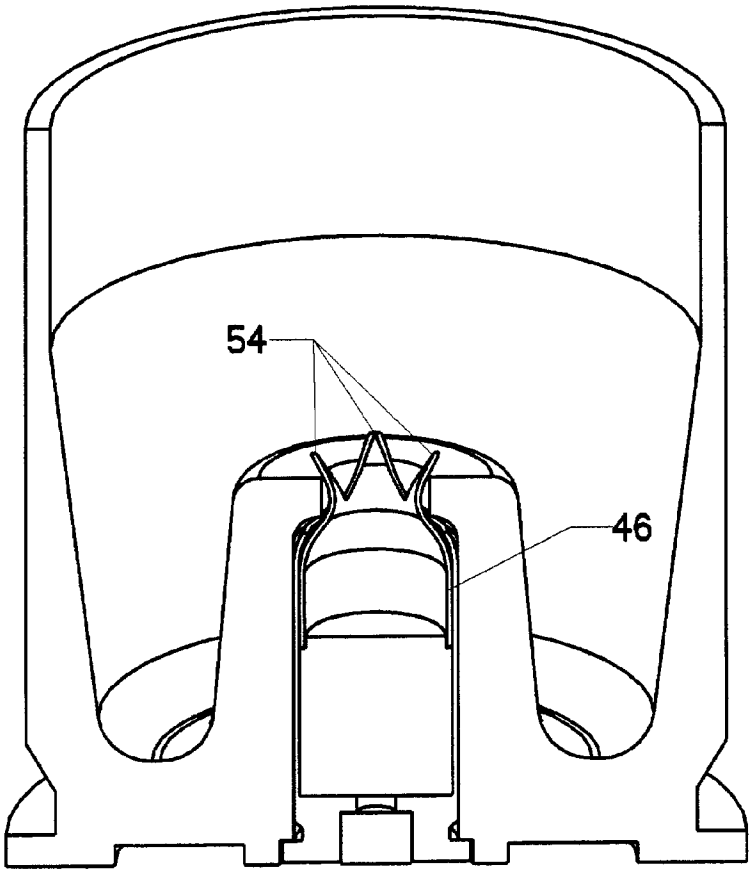
FIG. 10 is a section view, showing the components of he present invention after the burst cap has ruptured.
Figure 11:
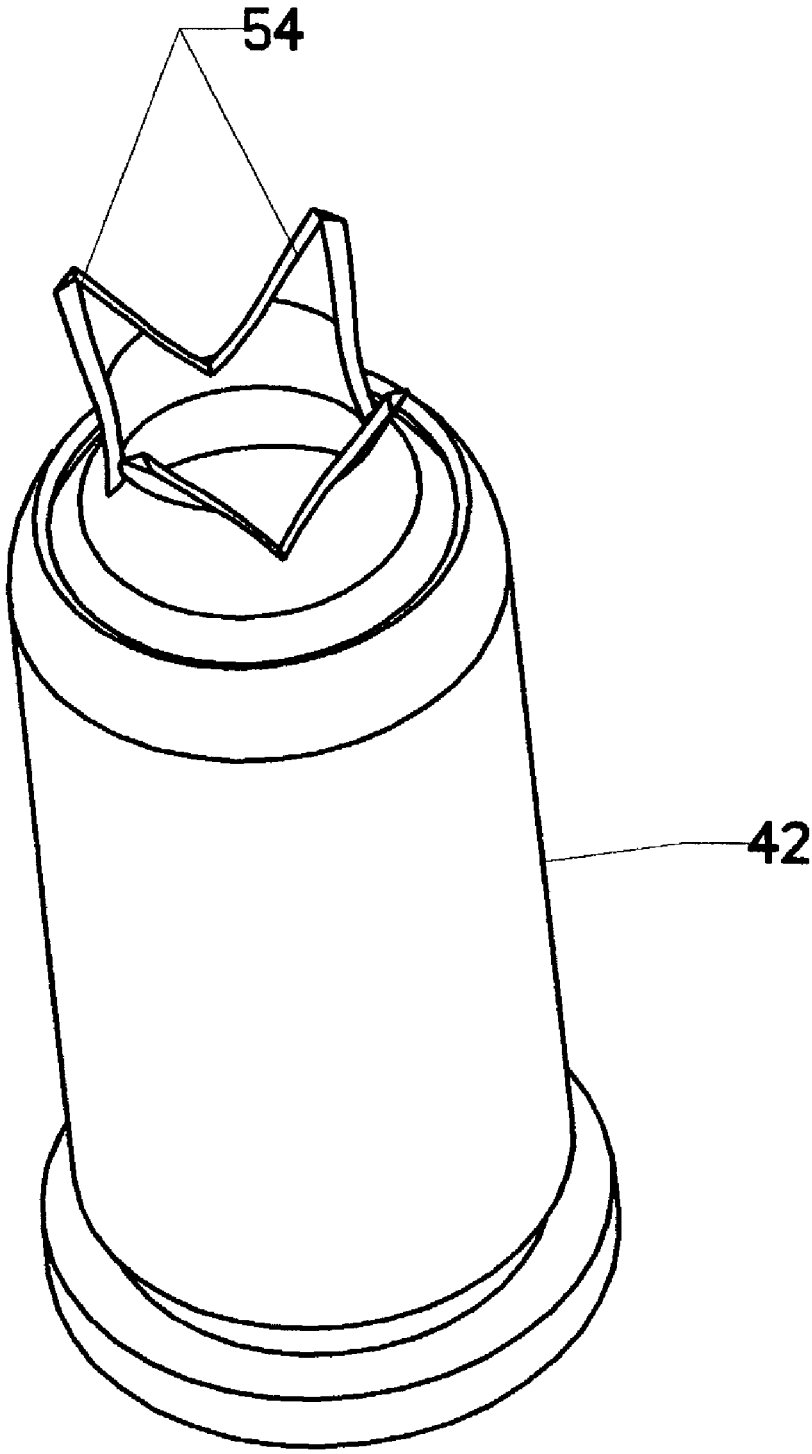
FIG. 11 is an isometric view, showing the ruptured burst cap.

Embossed lines 48 allow burst cap 46 to rupture in a consistent and predictable manner. FIG. 9 is a section view through case 12 with modified blank cartridge 62 in place. As with the prior art, the blank cartridge is surrounded by charge casing 28 and bulkhead 60, with bulkhead 60 being pierced by charge vent hole 52. The upper portion of burst cup 46 lies directly beneath charge vent hole 52. When the blank cartridge is ignited, the burning propellant causes a sharp rise in the pressure within the case. Burst cup 46 is retained by modified crimp 50 and bulkhead 60. Thus, the pressure within the case builds and creates even ignition. Once the desired pressure is reached, embossed lines 48 rupture (Those skilled in the art will know that many patterns could be used for embossed lines 48, depending on the number of resulting petals desired). FIG. 10 shows burst cup 46 after this rupture, with its upper portions having split into burst petals 54. Burst cup 46 thereby forms a nozzle which releases the high pressure propellant gases from high pressure cartridge 42. It is important to note that no solid matter is ejected from modified blank cartridge 62. FIG. 11 shows an isometric view of the ruptured burst cup 46 retained within high pressure cartridge 42 (with burst petals 54 protruding out the top).

In order to facilitate a complete understanding, it is helpful to compare the entire ignition and burn sequences for the prior art blank cartridge and the present invention. The prior art follows the following sequence: (1) Ignition of the primer; (2) Propellant ignition with initial pressure rise; (3) Expulsion of the filler and wad with a consequent sharp pressure drop; (4) Erratic burning of the remaining propellant.

The present invention follows the following sequence: (1) Ignition of the primer; (2) Propellant ignition with initial pressure rise; (3) Additional pressure rise to promote complete ignition; (4) Rupture of the burst disk, creating a metering nozzle; and (5) Sustained burning at even and elevated pressure until the propellant is completely consumed.

Figure 12:
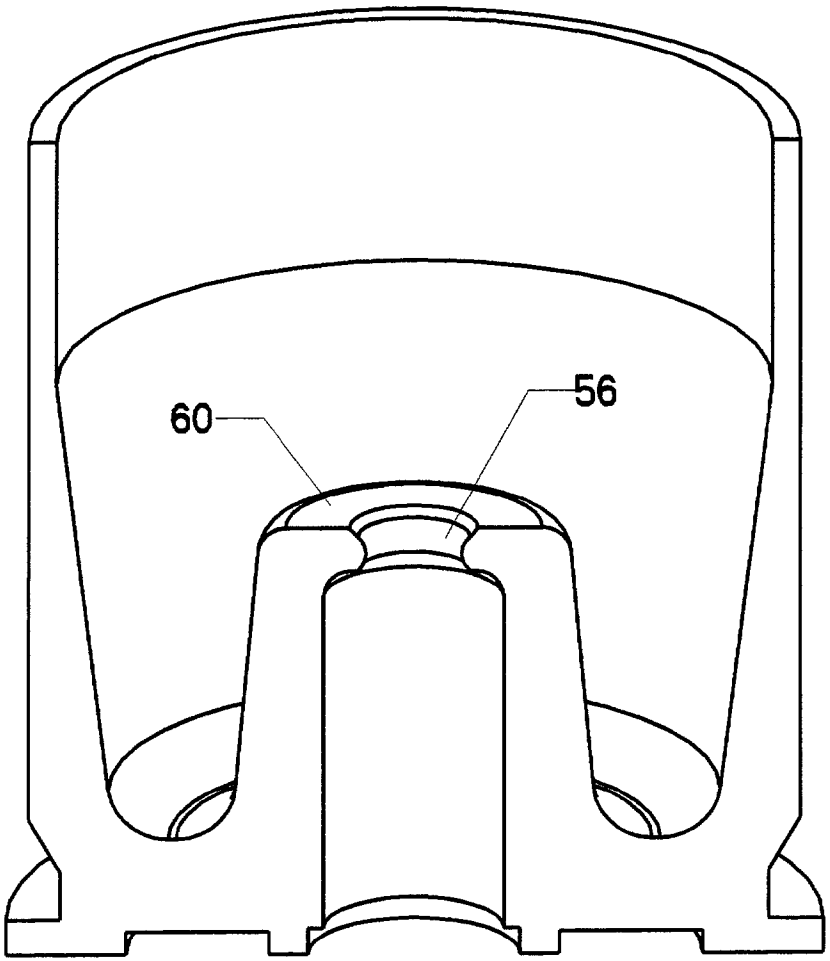
FIG. 12 is a section view, showing an improvement to the prior art charge hole.
Figure 13:
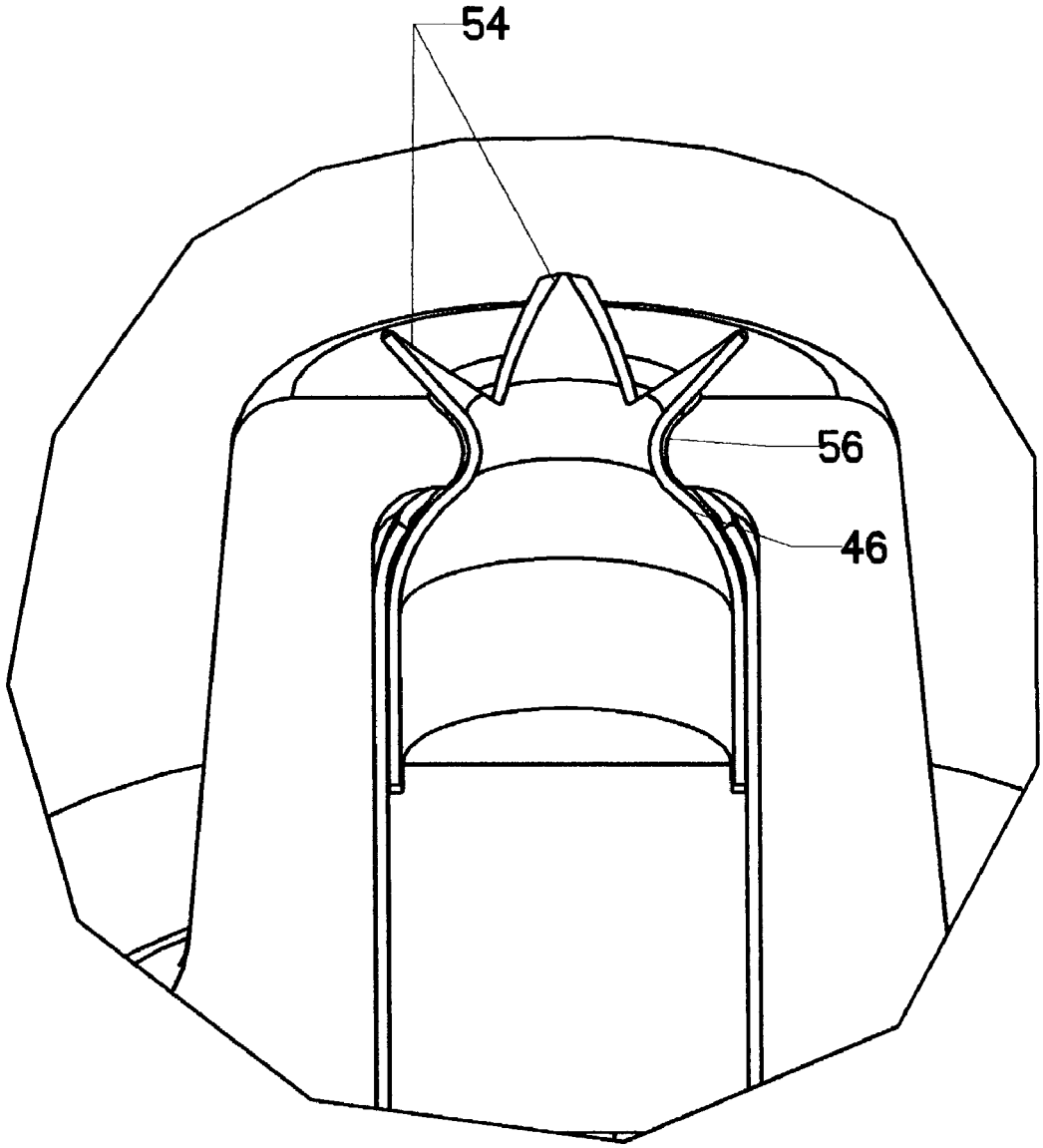
FIG. 13 is a section view, showing the interaction between the burst cap and the improved charge hole.

Those skilled in the art will realize that the metering of the high pressure propellant gases through the throat created by burst cup 46 and charge vent hole 52 is similar to the expansion of burning gases through a rocket nozzle. It is therefore advantageous to optimize the shape of charge hole 52 to create more consistent expansion and acceleration of the gases. One optimum configuration for such a nozzle is known as a DeLaval nozzle. FIG. 12 shows a modified version of case 12, wherein charge hole 52 has been modified into expansion nozzle 56. FIG. 13 shows this configuration with burst cup 46 in the ruptured state. Burst petals 54 tend to conform to the shape of the wall of expansion nozzle 56. The reader will recall that low pressure case 12 may be molded of plastic material in order to minimize expense. Thus, if unprotected, expansion nozzle 56 would tend to melt when exposed to the hot propellant gases. The overlay of petals 54 around the throat of expansion nozzle 56 allow it to survive the metering process substantially intact.

Figure 14:
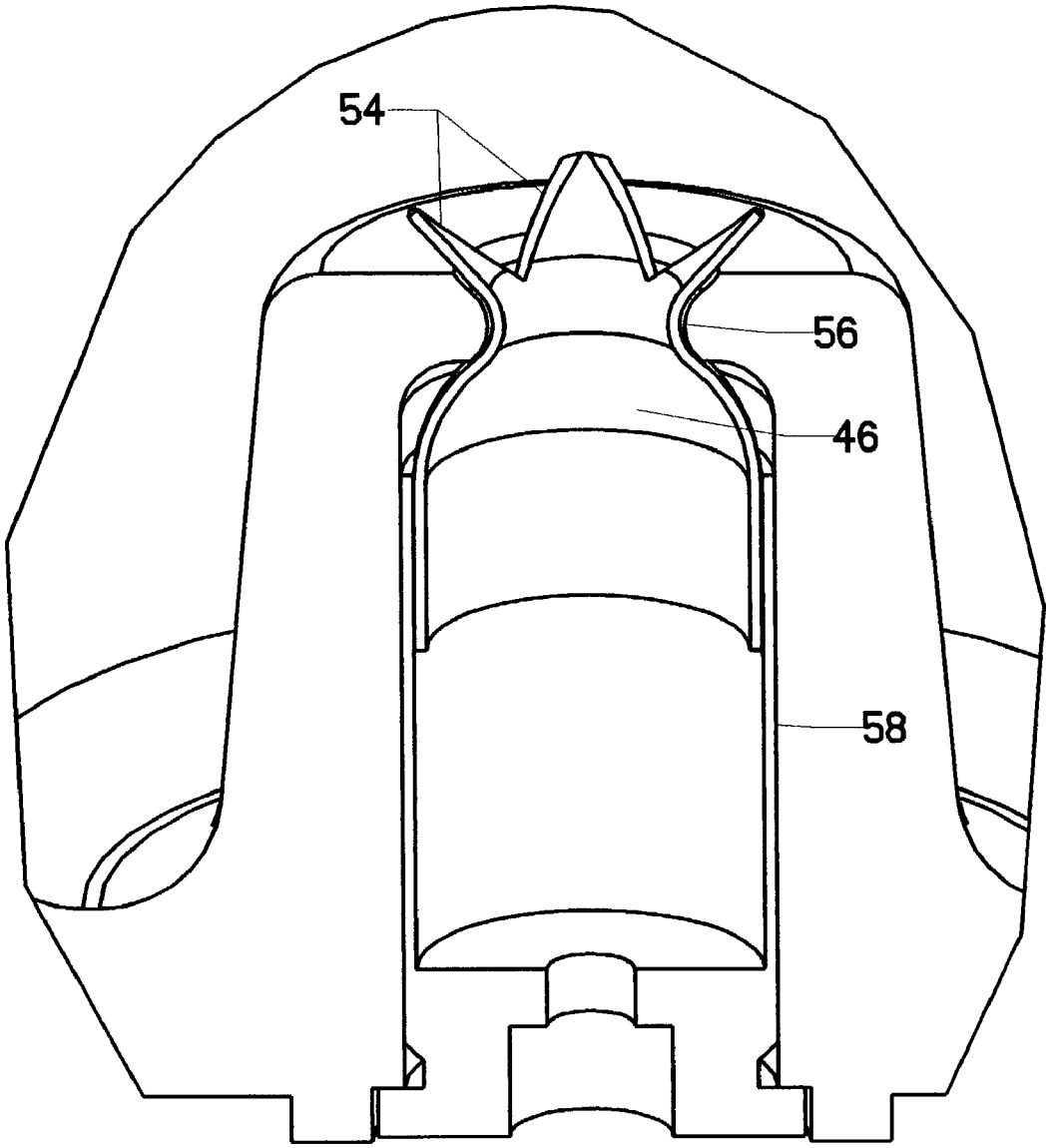
FIG. 14 is a section view, showing an uncrimped embodiment of the invention.

Having reviewed the preceding, those skilled in the art will realize that the use of modified crimp 50 with modified blank cartridge 62 is not strictly necessary. Burst cup 46 can be placed within high pressure cartridge 42 and externally retained. FIG. 14 shows such an embodiment loaded into case 12. Burst cup 46 is shown in the ruptured state. The reader will observe that the throat of expansion nozzle 56 has retained burst cup 46 without the use of modified crimp 50. Modified crimp 50 does, however, produce added stability to modified blank cartridge 62, especially prior to loading in low pressure case 12. Thus, the use of modified crimp 50 is preferable.

Figure 15:
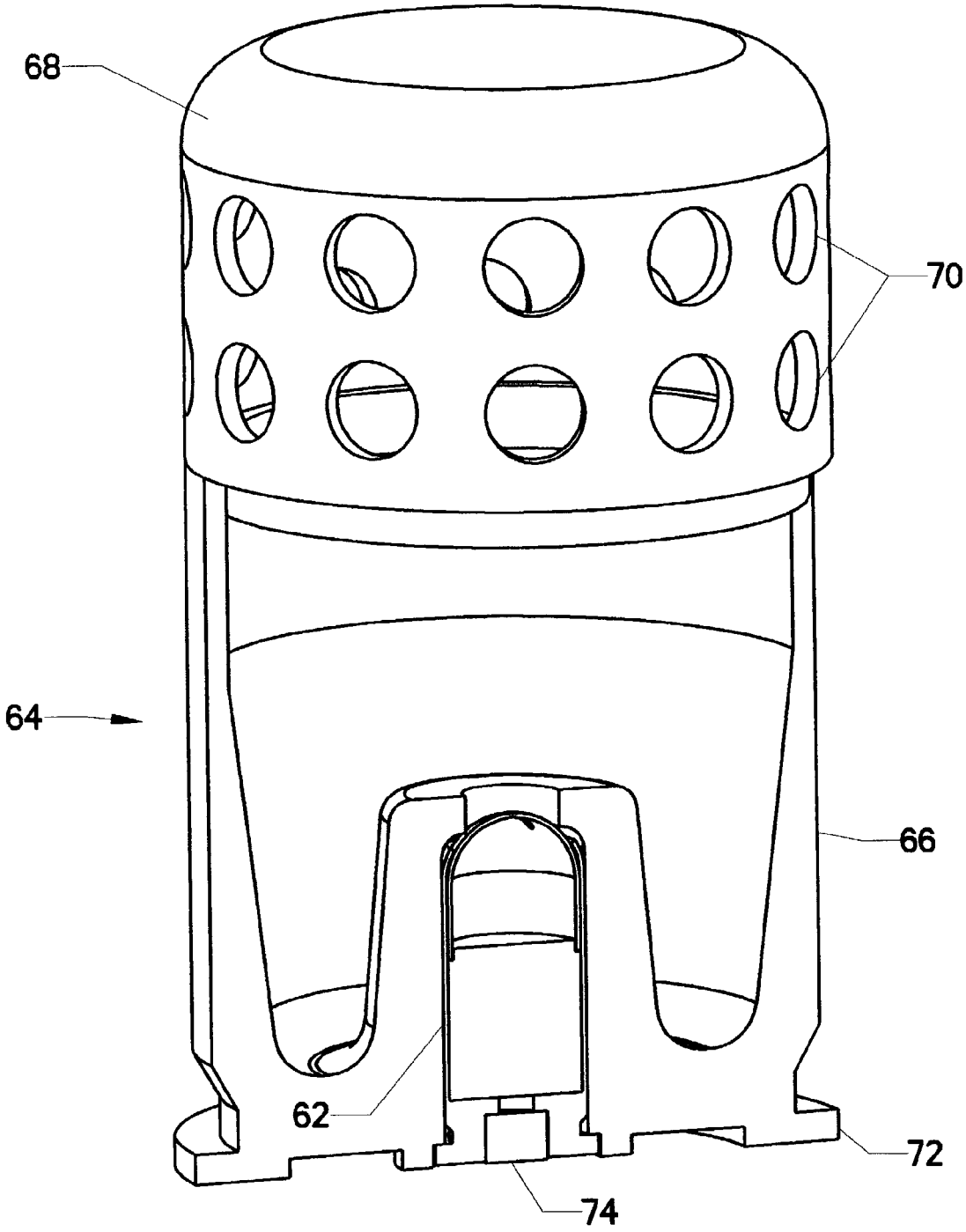
FIG. 15 is a section view, illustrating the present invention being used as an air bag inflation device.

Although the invention has been primarily illustrated as a component in a projectile round, those skilled in the art will realize that the invention has many other applications. FIG. 15 illustrates the use of the invention in air bag cartridge 64. Modified blank cartridge 62 is placed into low pressure case 66. Low pressure case 66 is mated to an airbag mount by mounting flange 72. Electrical primer 74 is substituted for the percussion primer ordinarily used, since the means of triggering an air bag to inflate are typically electrical.

Diffuser 68, which opens into a series of vent holes 70, is mated to low pressure case 66. Air bag cartridge 64 would typically be placed within an uninflated air bag. When the air bag must be inflated, an electrical signal is sent to ignite electrical primer 74. This action ignites the propellant, ruptures the burst cap, and causes a rapid but metered flow of gas into and through diffuser 68. The gas then escaping through vent holes 70 inflates the air bag.

Figure 16:
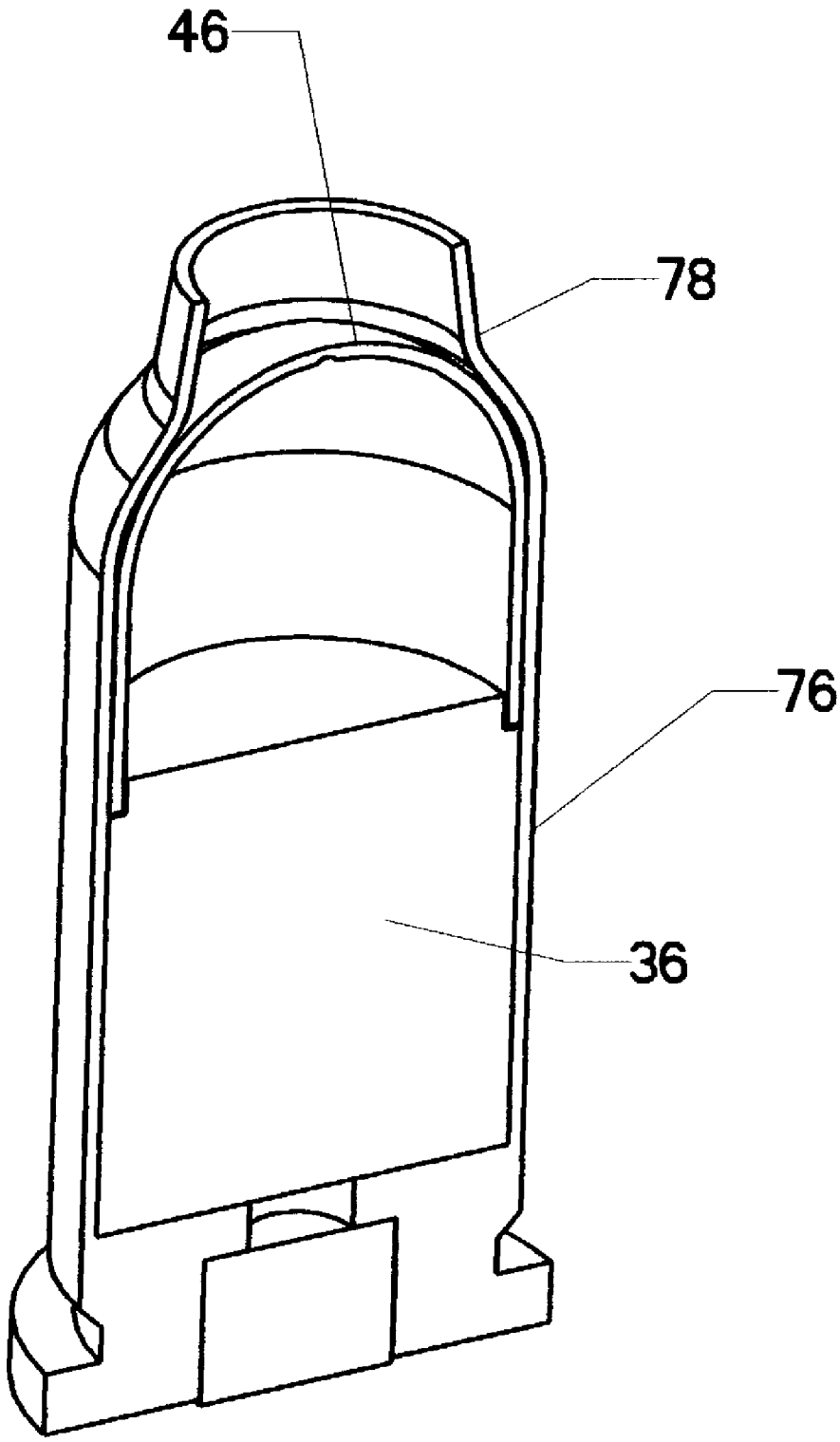
FIG. 16 is a section view, showing a necked version of the present invention.

FIG. 16 shows yet another embodiment for retaining burst cup 46 within a cartridge. Necked cartridge 76 is firmed by the following steps: (1) a straight-walled case is primed and charged with propellant 36; (2) Burst cup 46 is then inserted; and (3) neck 78 is formed to retain burst cup 46 in the appropriate position.

Figure 17:
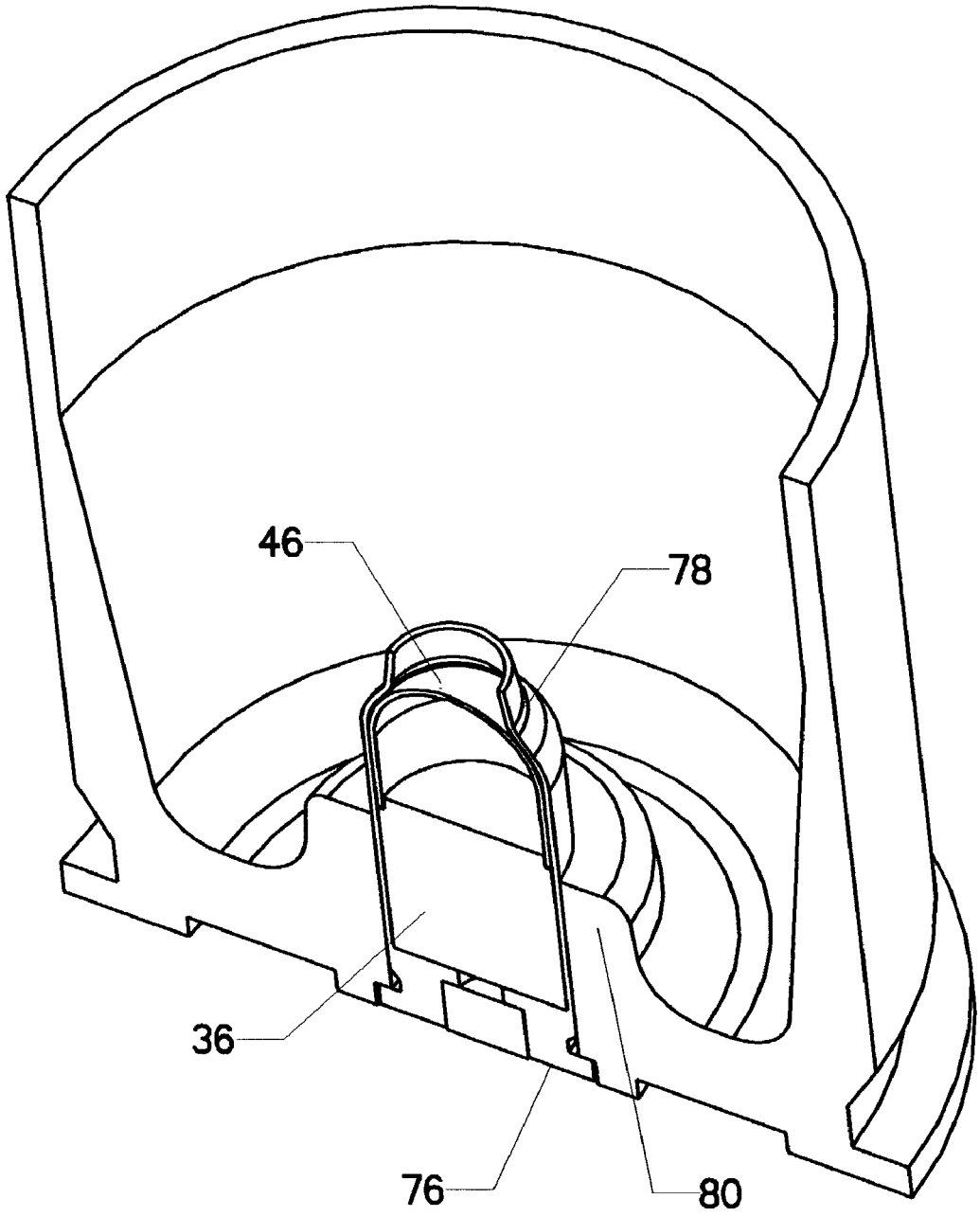
FIG. 17 is a section view showing the necked version installed in a modified low pressure case.

The addition of neck 78 considerably reinforces the side walls of necked cartridge 76. This additional strength reduces the need for surrounding reinforcement of the cartridge. FIG. 17 shows a modified low pressure case designed to utilize necked cartridge 76. Low wall casing 80 only encloses the head of necked cartridge 76. It is also possible—if brass of sufficient thickness is used to form necked cartridge 76 to eliminate low wall casing 80 altogether.

Figure 18:
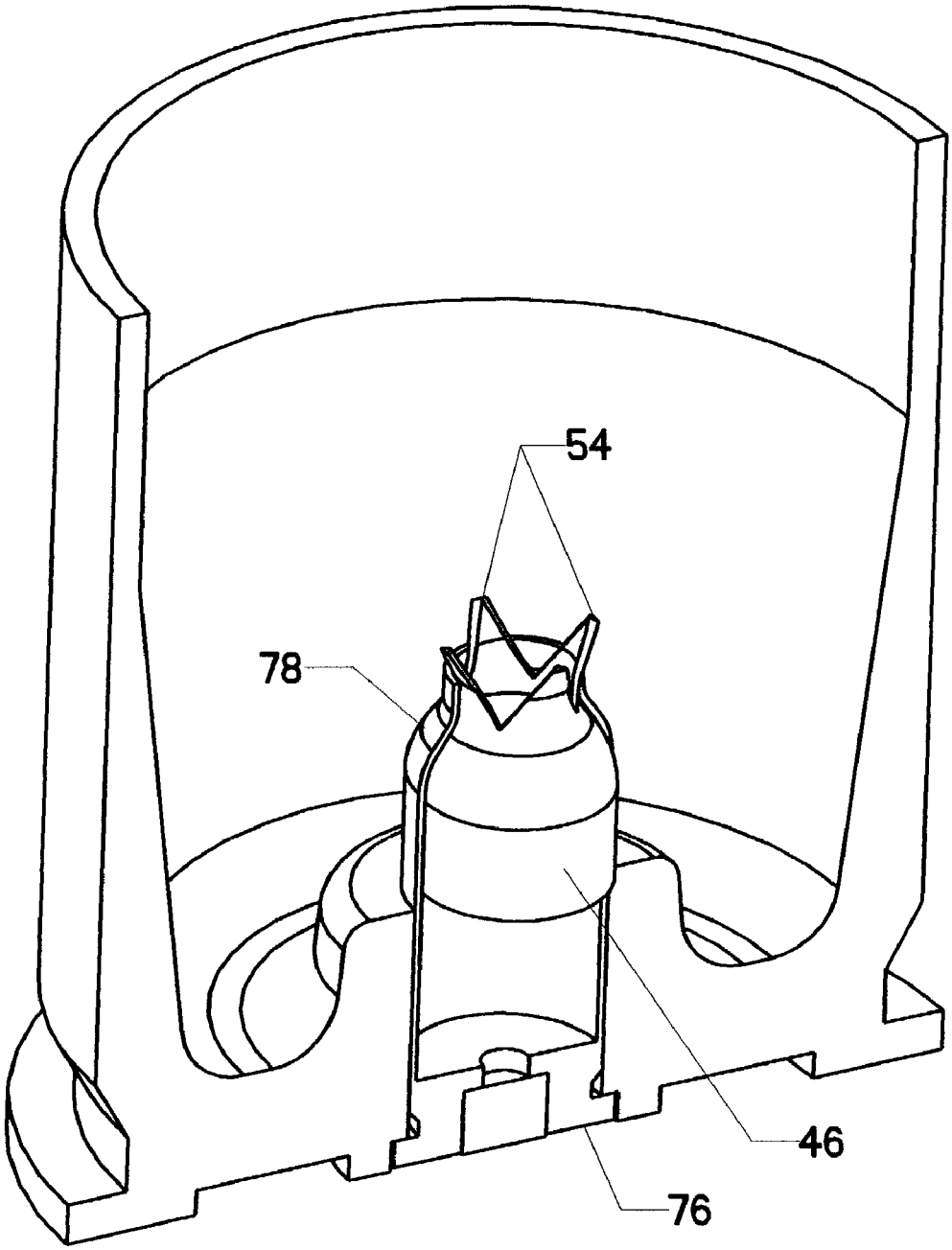
FIG. 18 is a section view, showing the necked version after firing.

FIG. 18 shows necked cartridge 76 after it has been fired. The reader will observe that the mechanical strength of neck 78 is sufficient to retain burst cup 46 without additional surrounding material.

Figure 19:
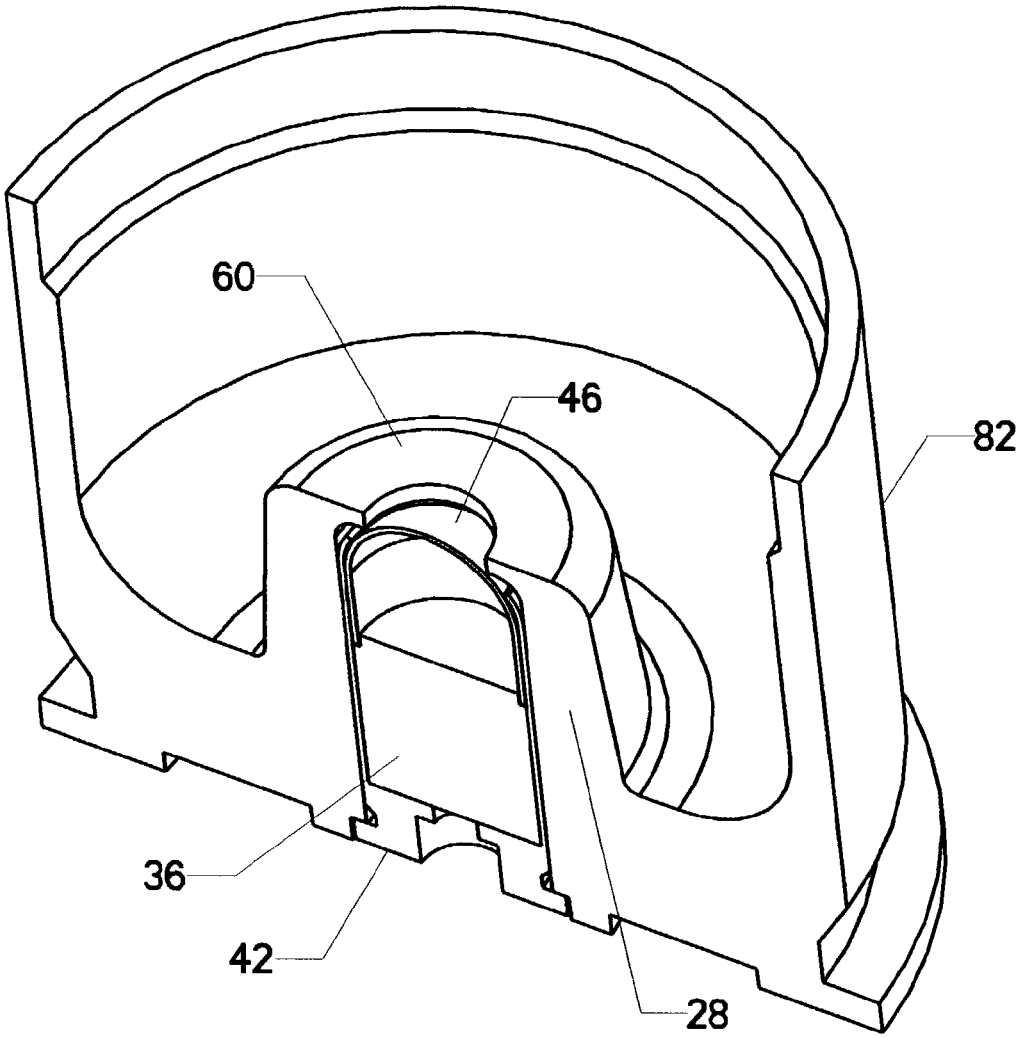
FIG. 19 is a section view, showing an M583 low pressure case.

Many additional applications are possible for the cartridge. FIG. 19 shows a shortened low pressure case that is used in a type of projectile designated M583. The reader will observe that M583 case 82 has shortened side walls. High pressure cartridge 82 is seated within charge casing 28—just as for the embodiment shown in FIG. 10.

Figure 20:
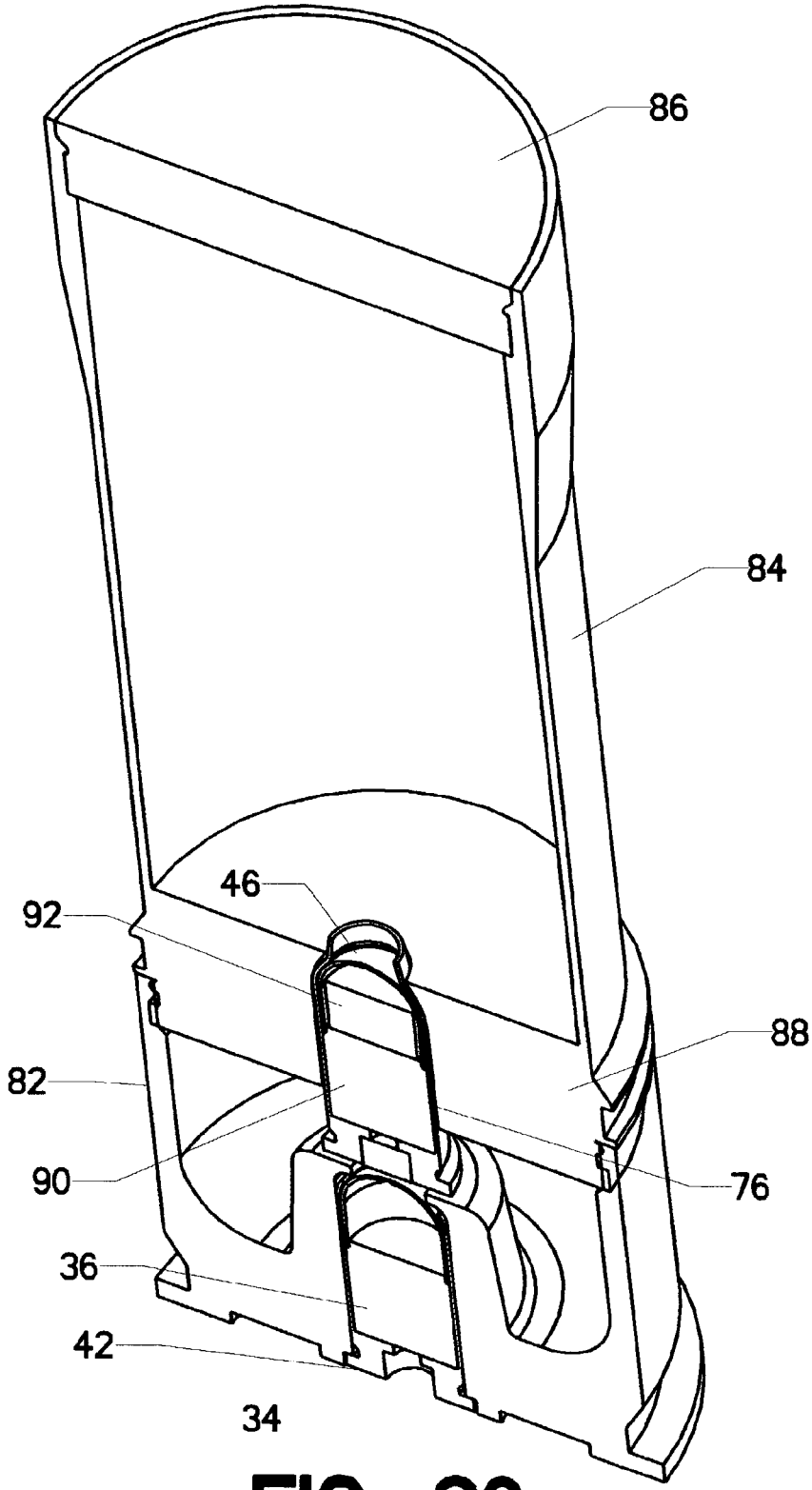
FIG. 20 is a section view, showing a complete M583 round.

FIG. 20 shows the balance of the M583 cartridge. Projectile container 84 is seated within the open mouth of M583 case 82. Container base 88 of projectile container 84 opens into a hole. In this hole is inserted necked cartridge 76. Necked cartridge 76 is modified from the embodiment shown in FIG. 16. First, it contains no primer. The primer pocket is simply left open. Second, the propellant is replaced with a duplex charge. The lower portion of the case is filled with delay charge 90. On top of this is deposited output charge 92.

Projectile container 84 is hollow it is sealed at its upper end by cap 86, which interlocks with the side walls of projectile container 84. The container typically contains a payload to be delivered for some purpose. One example would be a flare attached to a parachute (sometimes called a "star shell").

The operation of the device proceeds as follows: (1) The entire round is loaded into a firing chamber; (2) Percussion primer 34 in high pressure cartridge 42 is ignited; (3) The lower burst cup 46 ruptures, venting the pressurized propellant gases; (4) At the same time, the venting propellant gases ignite delay charge 90 in necked cartridge 76 (which burns slowly in a controlled fashion—for up to 5 seconds, or longer); (5) The venting propellant gases accelerate projectile container 84 down a rifled bore, sending it flying into space; (6) While projectile container 84 is arcing through its trajectory, delay charge 90 burns from the base of the cartridge up to output charge 92, whereupon it detonates output charge 92; (7) Output charge 92 ruptures he upper burst cup 46, throwing pressurized gases into the interior of projectile container 84; (8) Cap 86 blows free of projectile container 84; and (9) The contents of projectile container 84 (the "payload") are ejected.

If a flare with attached parachute is the payload, the hot gases flowing from necked cartridge 76 can also be used to ignite the flare. The embodiment shown in FIGS. 19 and 20 serves to illustrate the many different applications for the proposed invention.

Although the preceding description contains significant detail, it should not be construed as limiting the scope of the invention but rather as providing illustrations of the preferred embodiment of the invention. Thus, the scope of the invention should be fixed by the following claims, rather than by the examples given.

Having described my invention, I claim:

1. A cartridge for the controlled delivery of a fluid comprising:

a. a case, having a closed lower end, an open upper end, and a continuous vertical side wall thereby defining a hollow interior;

b. propellant, contained within said hollow interior of said case;

c. a hemispherical burst cup, having an open lower end and a closed upper end thereby defining a hollow interior, being embossed so as to rupture into a plurality of approximately uniform petals, and being placed within said open upper end of said case;

d. a charge casing surrounding and reinforcing said vertical side wall;

e. a bulkhead, completely joined to said charge casing and covering over the top of said burst cup;

f. means for securely holding said case within said charge casing and beneath said bulkhead;

g. ignition means to ignite said propellant, thereby creating pressurized propellant gases within said case; and h. wherein said bulkhead opens into a nozzle passing vertically therethrough, and wherein said nozzle lies directly over said burst cup so that when said propellant gases burst said burst cup into said plurality of approximately uniform petals, said petals will press tightly against said nozzle, thereby efficiently metering said propellant gases, and said nozzle will prevent the ejection of said burst cup from said case.

2. A cartridge as recited in claim 1, wherein said nozzle is formed in the shape of a DeLaval nozzle.

3. A cartridge for the controlled delivery of a fluid comprising:

a. a case, having a closed lower end, an open upper end, and a continuous vertical side wall thereby defining a hollow interior;

b. propellant, contained within said hollow interior of said case;

c. a hemispherical burst cup, having an open lower end and a closed upper end thereby defining a hollow interior, and being placed within said open upper end of said case;

d. a neck formed in said side wall of said case proximate said upper end of said case so as to lap said side wall over said burst cup, thereby capturing and retaining said burst cap within said case; and e. ignition means to ignite said propellant, thereby creating pressurized propellant gases within said case and bursting said burst cup to release said gases without ejecting said burst cup from said case.

4. A cartridge as recited in claim 3, wherein said burst cup is embossed so as to rupture into a plurality of approximately uniform petals.

5. A cartridge for the controlled delivery of a fluid comprising:

a. a case, having a closed lower end, an open upper end, and a continuous vertical side wall thereby defining a hollow interior;

b. a delay charge, contained within said hollow interior of said case proximate said lower end;

c. an output charge, contained within said hollow interior of said case proximate said upper end;

d. a burst cup, having an open lower end and a closed upper end thereby defining a hollow interior, and being placed within said open upper end of said case over said output charge;

e. a roll crimp formed in said side wall of said case proximate said upper end of said case so as to lap said side wall over said burst cup, thereby capturing and retaining said burst cup within said case; and f. ignition means to ignite said delay charge, so that said delay charge will subsequently ignite said output charge, thereby creating pressurized propellant gases within said case and bursting said burst cup to release said gases without ejecting said burst cup from said case.

6. A cartridge as recited in claim 5, wherein said burst cup is embossed so as to rupture into a plurality of approximately uniform petals.

7. A cartridge for the controlled delivery of a fluid comprising:

a. a case, having a closed lower end, an open upper end, and a continuous vertical side wall thereby defining a hollow interior;

b. a delay charge, contained within said hollow interior of said case proximate said lower end;

c. an output charge, contained within said hollow interior of said case proximate said upper end;

d. a hemispherical burst cup, having an open lower end and a closed upper end thereby defining a hollow interior, and being placed within said open upper end of said case over said output charge;

e. a neck formed in said side wall of said case proximate said upper end of said case so as to lap said side wall over said burst cup, thereby capturing and retaining said burst cup within said case; and f. ignition means to ignite said delay charge, so that said delay charge will subsequently ignite said output charge, thereby creating pressurized propellant gases within said case and bursting said burst cup to release said gases without ejecting said burst cup from said case.

8. A cartridge as recited in claim 7, wherein said burst cup is embossed so as to rupture into a plurality of approximately uniform petals.

* * * * *